US006237250B1

(12) United States Patent
Aguerre

(10) Patent No.: US 6,237,250 B1
(45) Date of Patent: May 29, 2001

(54) SANDAL HAVING ACTIVE SELF-ADJUSTING HARNESS AND METHOD

(75) Inventor: Santiago J. Aguerre, La Jolla, CA (US)

(73) Assignee: South Cone, Inc., San Diego, CA (US)

( * ) Notice: Subject to any disclaimer, the term of this patent is extended or adjusted under 35 U.S.C. 154(b) by 0 days.

(21) Appl. No.: 09/363,296

(22) Filed: Jul. 28, 1999

(51) Int. Cl.[7] ..... A43B 3/12
(52) U.S. Cl. ..... 36/11.5; 36/50.1
(58) Field of Search ..... 36/11.5, 7.5, 105, 36/50.1, 58.6

(56) References Cited

U.S. PATENT DOCUMENTS

| | | | | |
|---|---|---|---|---|
| Re. 35,452 | * | 2/1997 | Sargeant | 36/11.5 |
| 736,194 | * | 8/1903 | Bassett | 36/11.5 |
| 1,407,992 | * | 2/1922 | Doody | 36/11.5 |
| 1,894,561 | * | 1/1933 | Guiffre | 36/11.5 |
| 2,642,677 | * | 6/1953 | Yates | 36/11.5 |
| 4,584,782 | | 4/1986 | Thatcher | 36/11.5 |
| 4,793,075 | | 12/1988 | Thatcher | 36/11.5 |
| 5,438,767 | * | 8/1995 | Stein | 36/11.5 |
| 5,561,919 | * | 10/1996 | Gill | 36/44 |
| 5,659,978 | * | 8/1997 | Bell et al. | 36/11.5 |
| 5,870,837 | * | 2/1999 | Poulos | 36/11.5 |

* cited by examiner

*Primary Examiner*—Paul T. Sewell
*Assistant Examiner*—Jila Mohandesi
(74) *Attorney, Agent, or Firm*—Lewis Damato Brisbois & Bisgaard

(57) ABSTRACT

A sandal having an active, self-adjusting harness and method therefore typically used in the out-of-doors for rigorous activities includes rubber and synthetic materials and exhibits a lightweight robust, high-strength, flexible construction including an elongated sole for supporting a foot where the sole has a toe end and a heel end. A center toe strap is anchored in the toe end and includes a distal end fixedly connected to a front buckle. A rear strap is anchored in the heel end and has a first end and a second end extending above the sole. The first end and the second end of the rear strap are respectively connected to an inside rear buckle and an outside rear buckle. A self-adjusting harness comprised of a single strap is anchored in the toe end. The single strap includes an inside end and an outside end each extending above the sole. The inside end of the single strap is circuited through the front buckle and the inside rear buckle while the outside end of the single strap is circuited through the front buckle and the outside rear buckle. The inside end and the outside end are engaged to form a closure over-the-instep of the foot. Finally, an independent adjustable heel strap is attached to the outside rear buckle and the inside rear buckle. Subsequent movements of the foot result in continuous adjustments in the tension of the single strap for regulating and equalizing the tension in the harness.

13 Claims, 6 Drawing Sheets

SANDAL HAVING ACTIVE SELF-ADJUSTING HARNESS AND METHOD

BACKGROUND OF THE INVENTION

1. Field of the Invention

The present invention relates to footwear. More specifically, the present invention relates to methods and apparatus for a sandal having an active self-adjusting harness which cooperates with a center toe strap and an independent adjustable heel strap to provide for continuous adjustment for securely affixing the sandal to a human foot during physical activity.

2. Description of the Prior Art

The prior art is directed to methods and apparatus for sandal type footwear used during physical activities. Sandals are one of the first types of footwear known to mankind and continue to be popular. Early sandals included a flat component formed of a suitable material such as leather that served as a sole. The flat sole was placed under the foot to provide protection against the ground surface. Various methods to attach the sandal to the foot are also known. Some attachment examples include the use of a suitable material such as leather to attach the sole of the sandal to the toes or ankle of the foot.

In more recent times, a vamp which covers the instep of the foot was employed to provide a slide type sandal. The vamp only partially covered the top of the foot so that the toes might extend outward into the open air. In the alternative, the vamp may cover most of the top of the foot or even enclose the entire forward portion of the foot. Leather laces could be employed to improve the attachment of the slide type sandal to the foot by lashing the sole and/or the vamp of the sandal to the foot. However, neither of these types of means for attaching the sandal to the foot were satisfactory during rigorous physical activity.

The rear heel strap was subsequently introduced which was attached to the vamp or other structural component of the sandal. The rear heel strap was used to wrap around the heel of the foot to ensure that the sandal remained attached to the foot. Sandals often incorporated buckles, hook and eyelet fasteners and other types of mechanical fasteners to adjust the tension in the rear heel strap. The greater the tension in the rear heel strap, the tighter the sandal was attached to the foot. This feature was an improvement in securing the sandal to the foot during leisure activities. However, the rear heel strap often became loose during rigorous activities such as competing in baseball, beach ball sports and running in the sand to name a few. Under these conditions, the rear heel strap would slip down around the heel of the foot resulting in the sandal falling off of the foot.

Thus, sandals were subsequently modified to improve the attachment mechanism to the human foot for use during physical activity. In a first example, a sandal is known having an elongated sole configured to the profile of a human footprint. The sandal has a toe end and a heel end and employs a toe strap connected at two anchor points to grip the forward part of the wearer's foot. A heel strap is connected at two anchor points to grip the ankle of the wearer's foot. A lateral strap is connected between the toe strap and the heel strap which is located on the outside of the sole and parallel to its surface so that it is operable to stabilize the other straps and to maintain essentially constant tension in the individual straps as the sole flexes. The toe and heel straps are infinitely adjustable so that the wearer can cinch the sandal to his foot by adjusting the straps in a manner that the sandal will not be dislodged during rigorous activity.

In another example, a sandal construction includes a convertible heel harness which is employed to minimize foot slippage in its closed rearward position. Likewise, the convertible heel harness becomes a part of a frontal ankle strap in its alternate, forward position. The sandal may be slipped into and worn with an open back, or may be placed upon the foot with the harness engaging the heel.

Thus, there is a need in the art for a sandal intended for use during rigorous physical activity that includes an insole and an active, self-adjusting harness connected thereto wherein the harness is comprised of a single continuous strap having a plurality of strap sections. The self-adjusting harness in combination with a center toe strap and an independent adjustable heel strap functions to retain the sandal securely to a human foot. The harness is active in nature in that it is continuously self-adjusting and requires only a single over-the-instep strap closure to attach the sandal to the foot. The greater the upward pressure applied on the sandal, the tighter the harness becomes about the foot.

SUMMARY OF THE INVENTION

Briefly, and in general terms, the present invention provides a new and improved sandal typically worn as footwear in the out-of-doors during the warm months of the year. The sandal might typically be used during rigorous activities such as running, hiking and river rafting. However, the sandal can be used indoors as well as at the beach or the swimming pool. The novel and non-obvious sandal exhibits a cushioned insole layer and midsole layer upon which a human foot rests. The insole layer is mounted over and bonded to the midsole layer. The midsole layer is mounted over and bonded to a durable robust outsole layer which contacts the ground surface. The traction necessary to participate in rigorous activities is provided by the tread pattern included on the bottom of the outsole layer. The components of the sandal are comprised of rubber and manmade synthetic rubber and plastic cushioning materials. Further, the sandal exhibits a lightweight robust, high-strength, flexible construction and is economical to manufacture.

The insole, midsole and outsole layers are formed in the shape of a human foot having a toe end and a heel end. A center toe strap is anchored to the midsole layer and thus is stationary. The stationary center toe strap is connected to a front buckle. Likewise, a rear strap is anchored to the midsole layer and is connected to a pair of rear buckles. Anchored in the midsole layer and positioned above the insole layer is an active, self-adjusting harness comprised of a single strap. The single strap is circuited through each of the buckles and terminates in an over-the-instep closure. The harness in combination with the center toe strap and an independent adjustable heel strap provide the means by which the sandal is attached to the foot. Attachment can be accomplished by a single adjustment of the over-the-instep closure.

The present invention is generally directed to a sandal typically used in the out-of-doors and comprised of rubber and synthetic materials for exhibiting a lightweight robust, high-strength, flexible construction. In its most fundamental embodiment, the sandal comprises a construction having an elongated sole for supporting a foot where the sole has a toe end and a heel end. A center toe strap is anchored in the toe end and includes a distal end fixedly connected to a front buckle. A rear strap is anchored in the heel end and has a first end and a second end extending above the sole. The first end and the second end of the rear strap are respectively connected to an inside rear buckle and an outside rear buckle.

A self-adjusting harness comprised of a single strap is anchored in the toe end. The single strap includes an inside end and an outside end each extending above the sole. The inside end of the single strap is circuited through the front buckle and the inside rear buckle while the outside end of the single strap is circuited through the front buckle and the outside rear buckle. The inside end and the outside end are engaged to form a closure over-the-instep of the foot. Finally, an independent adjustable heel strap is attached to the outside rear buckle and the inside rear buckle. Subsequent movements of the foot result in continuous adjustments in the tension of the single strap for regulating and equalizing the tension in the harness.

These and other objects and advantages of the present invention will become apparent from the following more detailed description, taken in conjunction with the accompanying drawings which illustrate the invention, by way of example.

DESCRIPTION OF THE INVENTION

Figure 1:
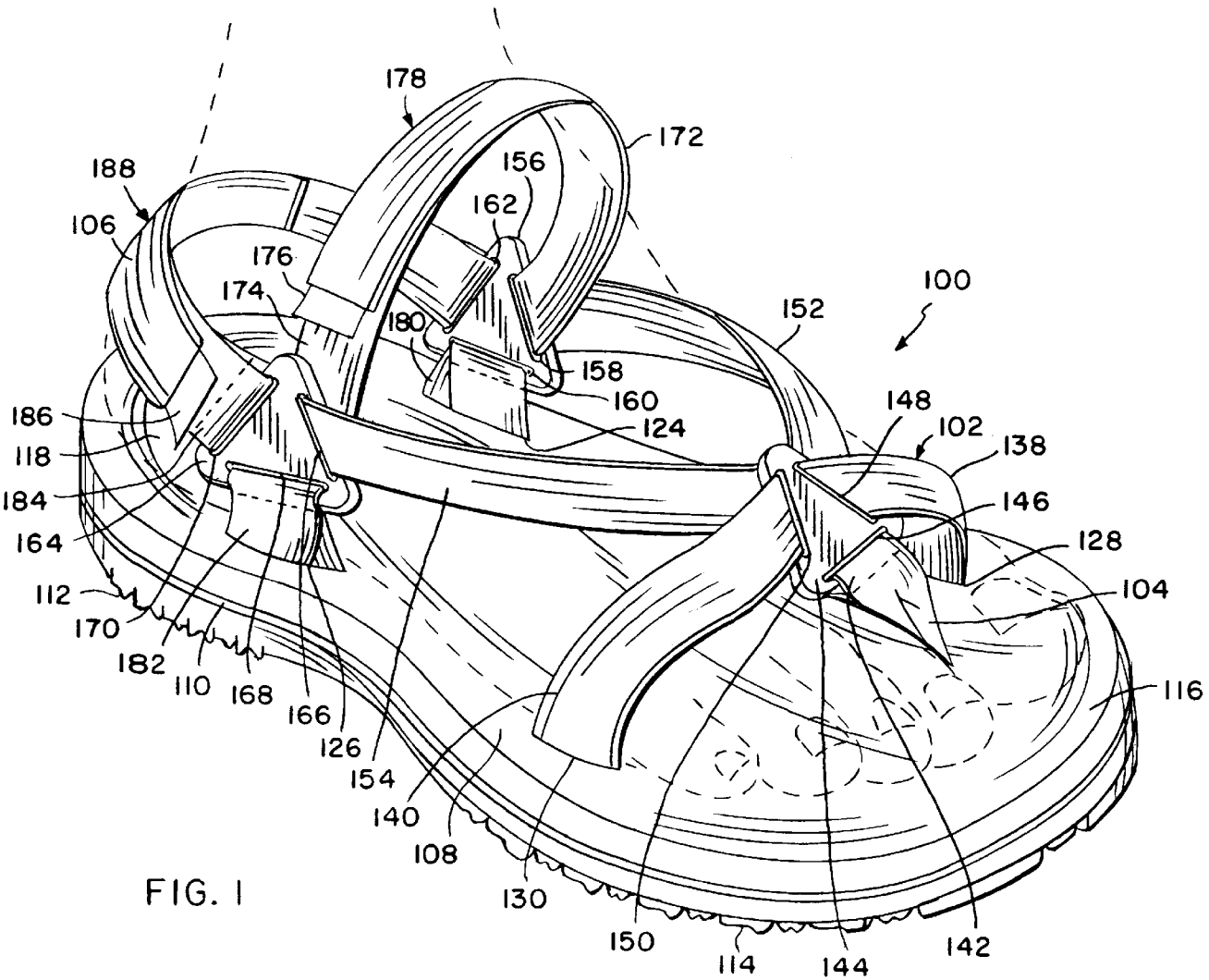
FIG. 1 is a front perspective view of a sandal having an active, self-adjusting harness of the present invention showing a self-adjusting, harness strap and an independent adjustable heel strap wrapped about a human foot shown in phantom.
Figure 2:
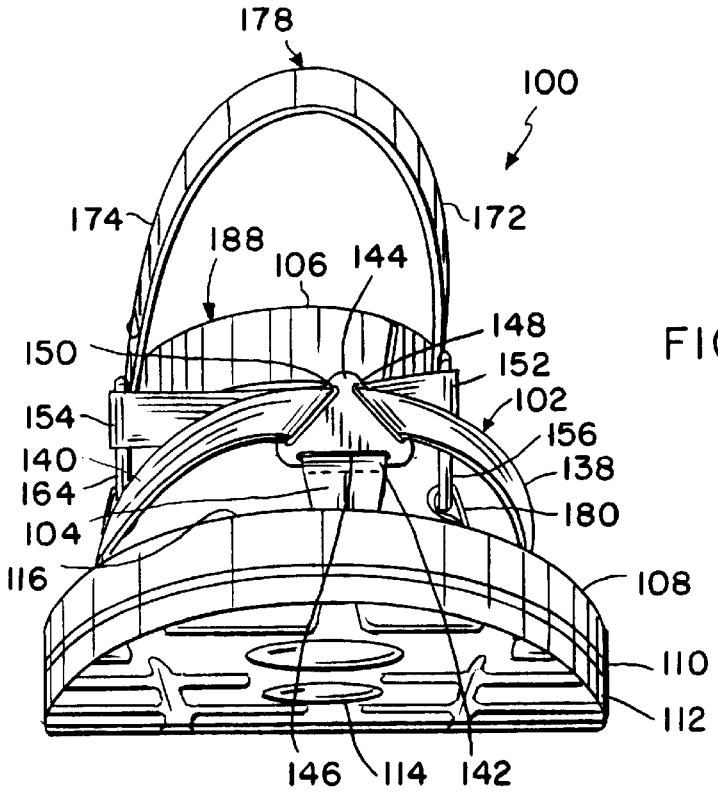
FIG. 2 is a front elevational view of the sandal of FIG. 1 showing the self-adjusting harness, a center toe strap, and front inside and outside strap sections and an over-the-instep strap section of the harness strap.
Figure 3:
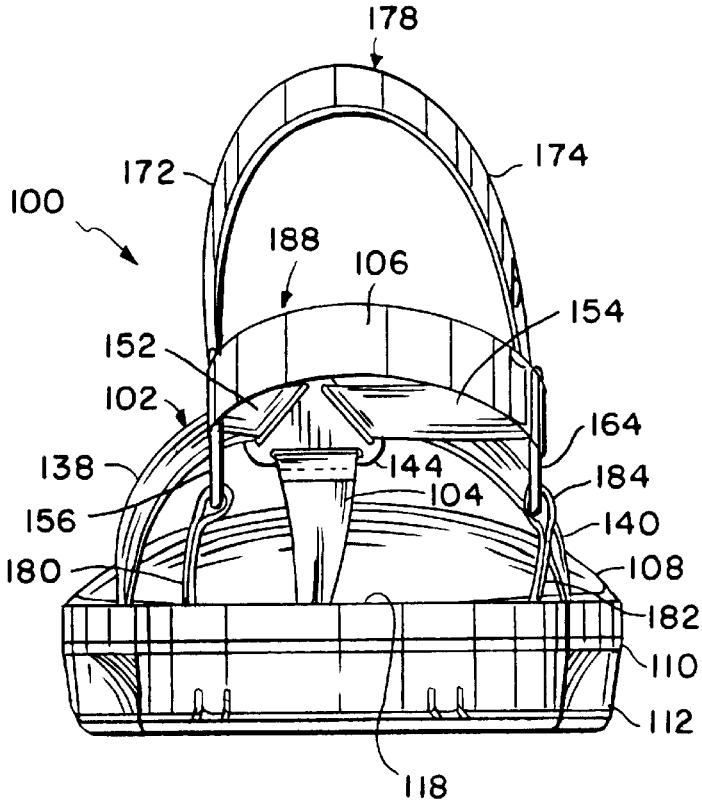
FIG. 3 is a rear elevational view of the sandal of FIG. 1 showing the self-adjusting harness, over-the-instep strap section of the harness strap, a center toe strap, and the independent adjustable heel strap.

The present invention is an article of footwear such as, for example, a sandal 100 having an active, self-adjusting harness 102 comprised of a single continuous strap having a plurality of strap sections. The self-adjusting harness 102 in combination with a center toe strap 104 and an independent adjustable heel strap 106 functions to retain an insole layer 108 of the sandal 100 to a human foot as is shown in FIG. 1.

Figure 7:
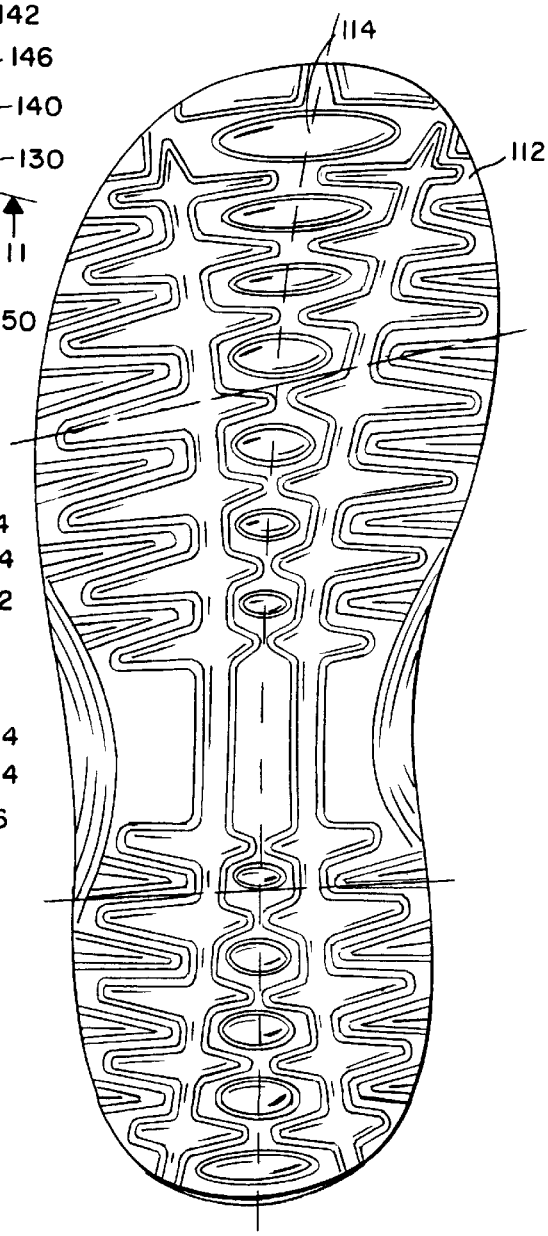
FIG. 7 is a bottom planar view of the sandal of FIG. 1 showing the rugged bottom surface of an outsole layer.
Figure 10:
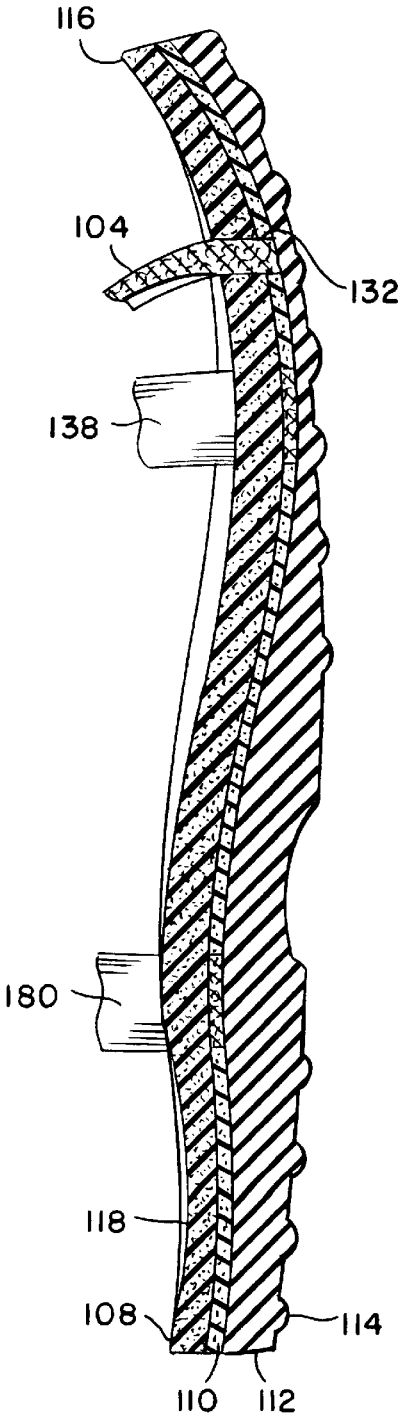
FIG. 10 is a longitudinal cross-sectional view of the sandal of FIG. 1 taken along the line 10—10 of FIG. 6 and showing the insole, midsole and outsole layers, center toe strap, a rear inside strap section of a rear strap, and the front inside strap section of the harness strap.

In addition to the plurality of straps mentioned in the previous paragraph which will be discussed in detail hereinbelow, the sandal 100 includes three layers of support for the foot. The three layers of support include the insole layer 108, a midsole layer 110 and an outsole layer 112 best shown in FIGS. 10–12 but also shown in FIGS. 4–5. The insole layer 108 is the top layer upon which the foot rests as is shown in FIG. 1. The outsole layer 112 includes a rugged, robust tread design 114 shown in FIG. 7 which makes contact with the ground surface. The midsole layer 110 is the middle layer positioned between the insole layer 108 and the outsole layer 112. The three layers of support are vertically stacked and bonded together with a suitable bonding agent well known in the art of shoe and sandal construction.

The insole layer 108 is the top layer that supports the foot and thus must be cushioned. Consequently, the insole layer 108 can be fashioned from synthetic plastic rubber, neoprene, microcellular rubber, Ethylene Vinyl Acetate (EVA) or any equivalent material suitable for sustained cushioning of the foot. The bottom outsole layer 112 includes the rugged, robust tread design 114 and thus must be fashioned from a tough, rugged material. Therefore, materials that are suitable for use in forming the outsole layer 112 include rubber, synthetic rubber and Thermal Plastic Rubber (TPR). The midsole layer 110 which is positioned between the insole layer 108 and the outsole layer 112 also serves as a cushioning medium. As a result, the midsole layer 110 can be fashioned from the same materials that are use to fashion the insole layer 108, i.e., synthetic plastic rubber, neoprene, microcellular rubber and EVA.

The three layers of support also include two other features that are shown in the drawing FIGS. and thus mentioned herein. A toe kick 116 is included in the design of the sandal 100 as is shown in FIGS. 2, 4, 5 and 10. The toe kick 116 is the upward extending portion located at the front of the sandal 100. The toe kick 116 is designed to keep the forward part of the foot from bumping external surfaces. Additionally, the toe kick 116 serves to make walking easier since the forward part of the foot is pointed in an upward direction prior to a step being taken. Additionally, a cup heel 118 is formed into the insole layer 108 of the sandal 100 as is shown in FIGS. 3–6 and 10. The function of the cup heel 118 is to persuade the heel of the foot to the center area of the cushioned insole layer 108.

Figure 8:
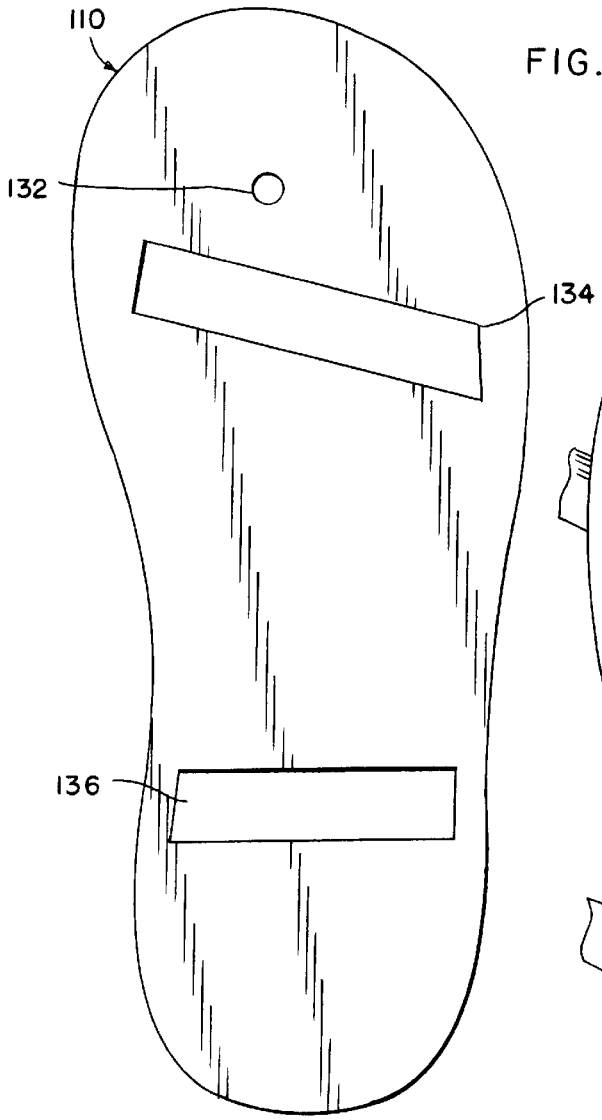
FIG. 8 is a top planar view of a midsole layer of the sandal of FIG. 1 showing a penetration and a pair of channels cut into the midsole layer for accommodating straps associated with the self-adjusting harness.
Figure 9:
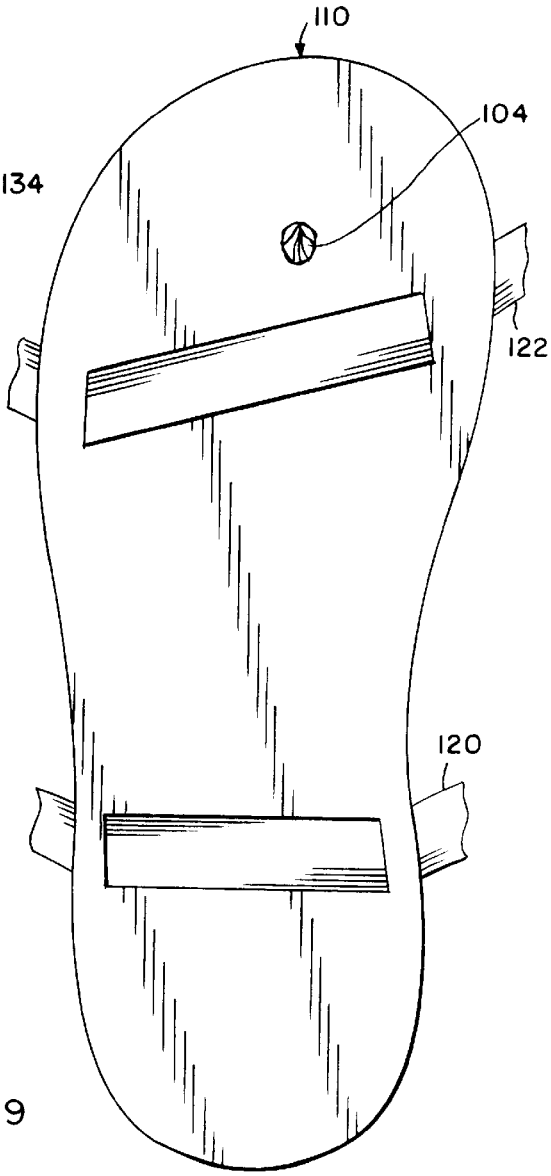
FIG. 9 is a bottom planar view of the midsole layer of the sandal of FIG. 1 showing straps positioned within the penetration a channels cut into the midsole layer.
Figure 11:
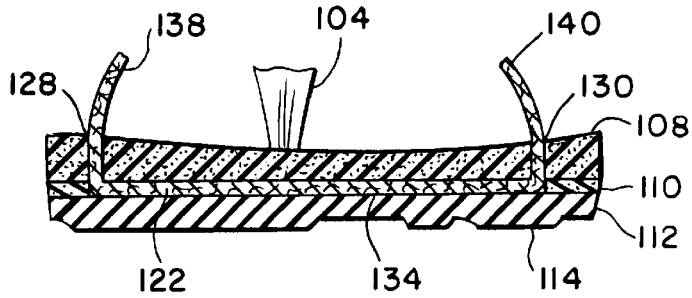
FIG. 11 is a first transverse cross-sectional view of the sandal of FIG. 1 taken along line 11—11 of FIG. 6 and showing the center toe strap and the front inside and outside strap sections of the harness strap positioned within the forward channel of the midsole.
Figure 12:
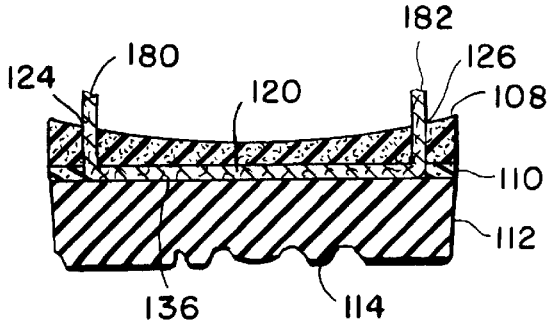
FIG. 12 is a second transverse cross-sectional view of the sandal of FIG. 1 taken along line 12—12 of FIG. 6 and showing the rear inside and outside strap sections of the rear strap.

In the sandal 100 of the present invention, the midsole layer 110 serves another function. Three of the straps used to secure the sandal 100 to the foot are anchored between the insole layer 108 and the outsole layer 112. These straps include the center toe strap 104, a rear strap 120 (shown in FIG. 12), and a single strap 122 (shown in FIG. 11) comprised of several strap sections discussed hereinbelow (and that collectively form the self-adjusting harness 102). In order to accommodate the anchoring of these straps between the insole layer 108 and the outsole layer 112, the straps must be able to pass through these layers. Consequently, four slots 124, 126, 128 and 130 are cut into the insole layer 108 to enable the rear strap 120 and the single strap 122 to pass therethrough as shown in FIGS. 1, 11 and 12. Additionally, a penetration 132 is also formed in the forward part of the insole layer 108 and the midsole layer 110 as shown in FIGS. 8 and 9. The four slots 124, 126, 128 and 130 and the penetration 132 are the origin of the five anchor points associated with the sandal of the present invention 100.

In order to accommodate the rear strap 120 passing through the slots 124 and 126 and the single strap 122 passing through the slots 128 and 130, a pair of channels 134 and 136 are cut into the midsole 110 as shown in FIG. 8. When the rear strap 120 has passed through the slot 124, it is then turned inward and laid flat into the channel 136 and subsequently circuited out of slot 126 as shown in FIGS. 8, 9 and 12. Once the rear strap 120 is properly located, it is then cemented or bonded in position in channel 136. Likewise, when single strap 122 has passed through slot 128, it is then turned inward and laid flat into the channel 134 and subsequently circuited out of slot 130 as shown in FIGS. 8, 9 and 11. Once the single strap 122 is properly located, it is also cemented or bonded with a suitable adhesive in position in channel 134. Further, the center toe strap 104 is positioned into the penetration 132, turned inward and then cemented or bonded in position as shown in FIG. 9. Thereafter, the insole layer 108 is positioned over and bonded to the midsole layer 110 to complete the construction. The rear strap 120, single strap 122 and center toe strap 104 are now properly anchored between the insole layer 108 and the outsole layer 112. Use of the channels 134 and 136 has enabled the avoidance of lumps between the insole layer 108 and the outsole layer 112 that otherwise would be present.

We now turn our attention to the various strap sections that comprise the harness 102 as shown in FIG. 1. As previously noted, the harness 102 is formed from the single strap 122 shown in FIG. 11. However, when the single strap 122 emerges from the slots 128 and 130 in the insole layer 108, it is advantageous to provide each section of the single strap 122 with a separate identification number. Consequently, the section of the single strap 122 emerging from the slot 128 is referred to as the front inside strap section 138. The section of the single strap 122 emerging from the slot 130 is referred to as the front outside strap section 140. Connected to a distal end 142 of the center toe strap 104 is a front buckle 144 having three slots 146, 148 and 150 formed therein. The distal end 142 of the center toe strap 104 wraps about the slot 146 as shown in FIG. 1. Since the front buckle 144 is connected to the center toe strap 104, the front buckle 144 is stationary in position and will not move during the self-adjustments of the harness 102. The front inside strap section 138 is then circuited through the slot 148 formed in the front buckle 144. Likewise, the front outside strap section 140 is then circuited through the slot 150 formed in the front buckle 144. The front inside strap section 138 and the front outside strap section 140 in combination with the center toe strap 104 captures the metatarsal area for securing the sandal 100 to the forward part of the foot by limiting the forward and lateral motion of the foot (i.e., no forward or side movement of the foot).

Once the front inside strap section 138 passes through the slot 148 of the front buckle 144, it becomes the inside lateral strap section 152 as shown in FIG. 1. Likewise, once the front outside strap section 140 passes through slot 150 of the front buckle 144, it becomes the outside lateral strap section 154. The inside lateral strap section 152 and the outside lateral strap section 154 in combination serve to limit lateral movement of the foot within the sandal 100.

Figures 4, 5:
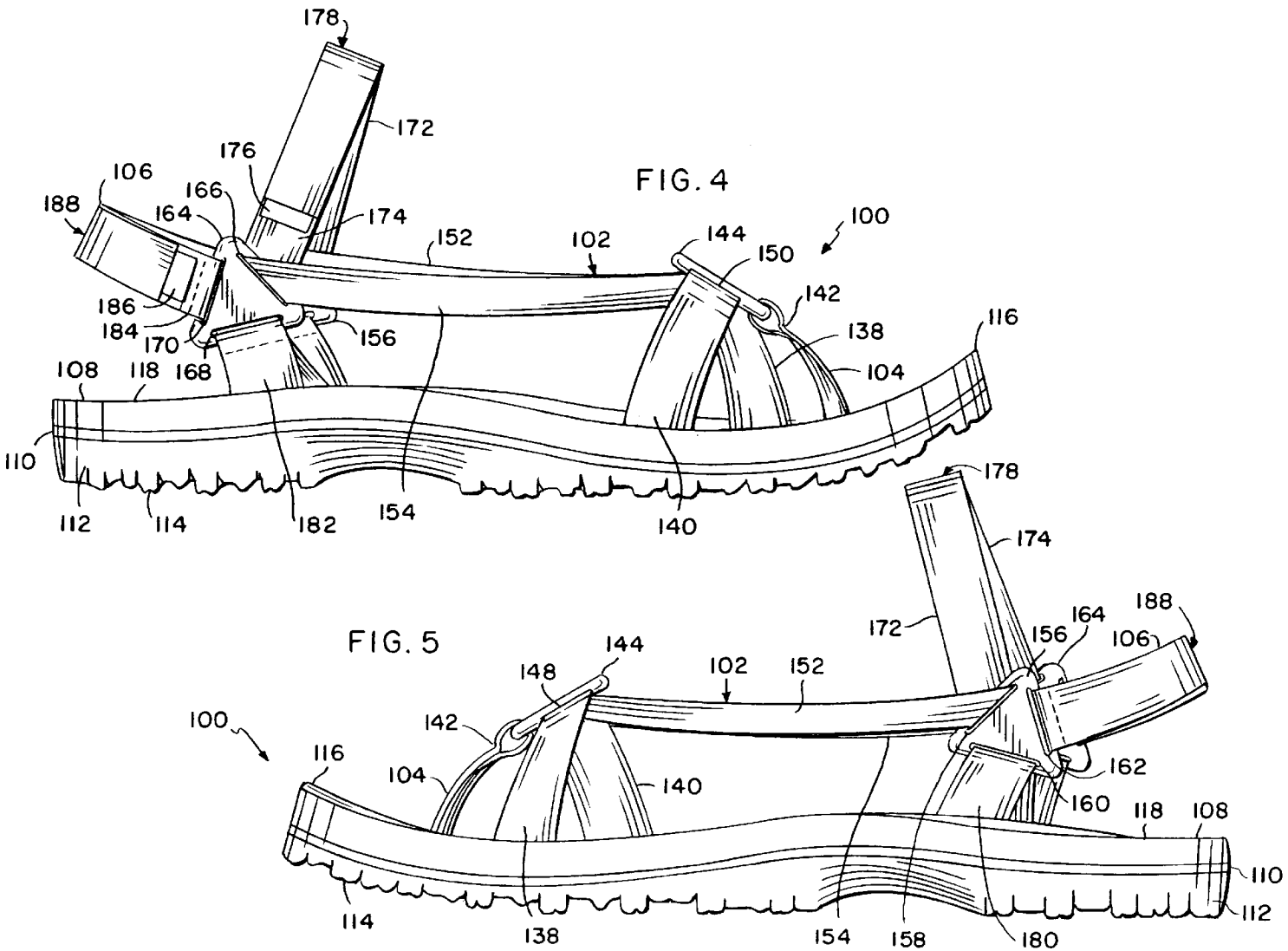
FIG. 4 is a right side elevational view of the sandal of FIG. 1 showing the self-adjusting harness, adjustable heel strap, a center toe strap, and front inside and outside strap sections, inside and outside lateral strap sections, and over-the-instep strap section of the harness strap.
FIG. 5 is a left side elevational view of the sandal of FIG. 1 showing the self-adjusting harness, center toe strap, adjustable heel strap, and front inside and outside strap sections, inside and outside lateral strap sections, and over-the-instep strap section of the harness strap.
Figure 6:
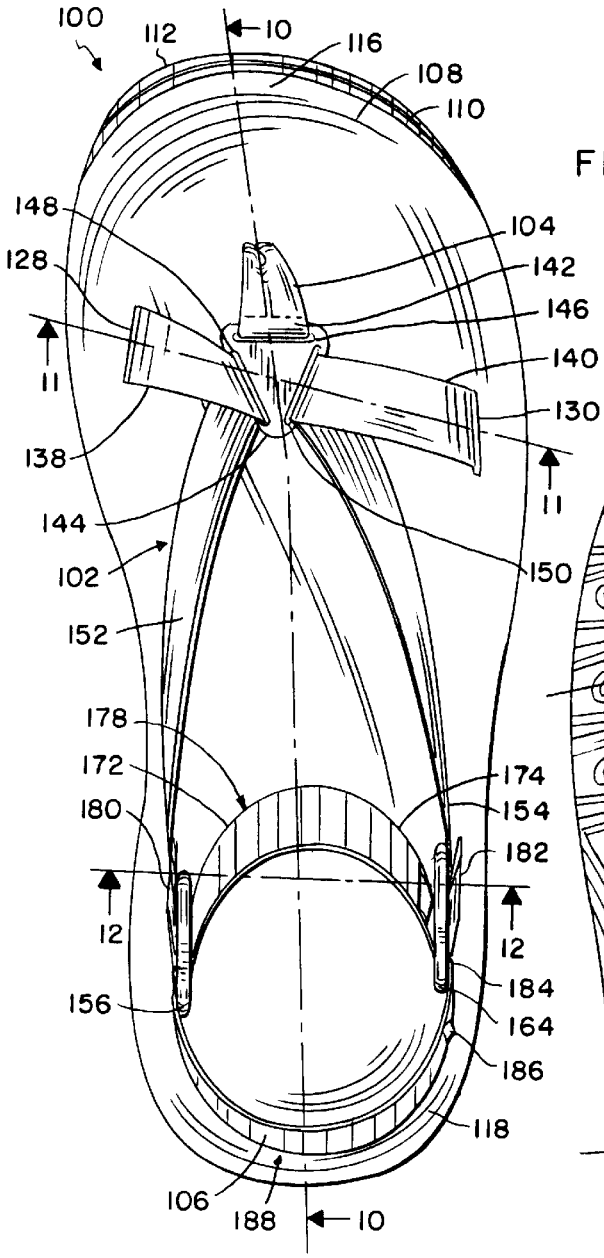
FIG. 6 is a top planar view of the sandal of FIG. 1 showing the self-adjusting harness, center toe strap, adjustable heel strap, and front inside and outside strap sections, front inside and outside lateral strap sections, and over-the-instep strap section of the harness strap, all mounted upon an insole layer.

The inside lateral strap section 152 is then circuited to an inside rear buckle 156 having slots 158, 160 and 162 formed therein best shown in FIG. 5. Likewise, the outside lateral strap section 154 is then circuited to an outside rear buckle 164 having slots 166, 168 and 170 formed therein best shown in FIG. 4. The inside lateral strap section 152 is circuited through slot 158 of the inside rear buckle 156 and becomes a first terminal end 172 of the single strap 122. The outside lateral strap section 154 is then circuited through slot 166 of the outside rear buckle 164 and becomes a second terminal end 174 of the single strap 122. The first terminal end 172 and the second terminal end 174 of the single strap 122 are engaged using a hook and loop fastener 176 to form an over-the-instep closure 178 as shown in FIG. 1. The over-the-instep closure 178 functions as the single point where adjustments of the harness 102 are made.

The rear strap 120 best shown in FIG. 12 includes an inside rear strap section 180 and an outside rear strap section 182 shown extending above the insole layer 108 in FIG. 1. The inside rear strap section 180 is looped about the slot 160 of the inside rear buckle 156 as shown in FIG. 5. Likewise, the outside rear strap section 182 is looped about slot 168 of the outside rear buckle 164 as shown in FIG. 4. The inside rear strap section 180 and the outside rear strap section 182 function to hold the inside rear buckle 156 and the outside rear buckle 164 in a stationary position.

The independent adjustable heel strap 106 shown in FIG. 1 is attached at a distal end 184 to slot 170 of the outside rear buckle 164 as shown in FIG. 1. The heel strap 106 is then circuited around the back side of the sandal 100 and through slot 162 of the inside rear buckle 156. That portion of the heel strap 106 extending through the slot 162 of the inside rear buckle 156 is then engaged with that portion of the heel strap 106 extending between the outside rear buckle 164 and the inside rear buckle 156. The engagement is accomplished by using a hook and loop fastener 186 to form a heel closure 188 as shown in FIG. 1. The heel closure 188 functions to prevent the foot from slipping out of the sandal 100. The heel closure 188 also functions to (a) offset and equalize the tension in the inside rear buckle 156 caused by the tension in the inside lateral strap section 152 and to (b) offset and equalize the tension in the outside rear buckle 164 caused by the tension in the outside lateral strap section 154. It is noted that the foot only escapes the harness 102 by moving backwards and the foot can only move backwards if the heel closure 188 and the over-the-instep closure 178 are released, i.e., the hook and loop fastener 186 and the hook and loop fastener 176 are respectively disengaged.

During operation, the sandal 100 is placed on the foot and the heel closure 188 is adjusted once. Thereafter, only the over-the-instep closure 178 needs to be adjusted. With one adjustment of the hook and loop fastener 176, the harness 102 is tensioned and the sandal 100 fits snugly to the foot. The sandal 100 of the present invention includes the harness 102 that is active, i.e., continuously self-adjusting. This means that movements of the foot result in continuous adjustments in the tension of the single strap 122 for regulating and equalizing the tension in the harness 102. This action is accomplished in the following way.

Notwithstanding the over-the-instep closure 178 is engaged, the front inside strap section 138 and the inside lateral strap section 152 are free to move through the front buckle 144. Likewise, the front outside strap section 140 and the outside lateral strap section 154 are also free to move through the front buckle 144. Once the heel closure 188 is adjusted, the independent adjustable heel strap 106 is stationary. Further, the front buckle 144 is fastened to the stationary center toe strap 104 and thus is itself stationary. Thus, the stationary front buckle 144 prevents the foot from moving forward or laterally. Consequently, movements of the foot affect the tension in (a) the front inside strap section 138 and the inside lateral strap section 152, and (b) the front outside strap section 140 and the outside lateral strap section 154.

For example, when the foot is extended outward during walking (i.e., when a step is taken), the toe section of the foot is raised which raises the forward portion of the sandal 100. This motion increases the pressure on the instep area of the foot which tightens the over-the-instep closure 178 and draws any slack out of the inside lateral strap section 152 and the front inside strap section 138, and the outside lateral strap section 154 and the front outside strap section 140, respectively. This results in increased tension in the harness 102 about the metatarsal area of the foot. However, when the foot is lowered to land a step (and the toe section of the foot is lowered), the inside and outside lateral strap sections 152 and 154 are pulled forward. This is the case since there is less tension on the independent adjustable heel strap 106 at the rear portion of the sandal 100 because the ankle is tilted backwards. Thus, the extra slack in the adjustable heel strap 106 is taken up by the forward components of the harness 102 and the overall tension is regulated and equalized.

In another example, increasing the upward pulling force on the sandal 100 (such as if the sandal 100 is stuck in mud or wedged between rocks) increases the pressure on the instep area of the foot. Consequently, the forward strap sections of the single strap 122 are tensioned resulting in a tightening of the harness 102 about the metatarsal area. Likewise, movements of the foot that decrease the upward pulling force on the sandal 100 cause the harness 102 to relax about the metatarsal area.

It is noted that the corresponding (left foot) sandal that is a mate to the (right foot) sandal 100 shown in drawing FIGS. 1–12 is a mirror image of the sandal 100 of the present invention. The circuiting of the strap sections of the single strap 122 can be modified and the harness 102 will continue to function properly. The hook and loop fasteners 176 and 186 can be replaced with other equivalent mechanical attachment means.

The present invention provides novel advantages over other sandal footwear known in the art. A main advantage of the sandal 100 of the present invention is that the active, self-adjusting harness 102 is comprised of a single strap 122 which is circuited through each of the buckles 144, 156 and 164. This design enables the formation of the over-the-instep closure 178 which requires minimum adjustments to attach the sandal 100 to the foot at a single closure point. Further, the stationary center toe strap 104 retains the front buckle 144 in a fixed position so that the front buckle 144 does not move toward the instep of the foot during adjustment of the harness 102. Thus, the self-adjusting feature of the harness 102 will function properly. Additionally, under conditions when the bottom of the sandal 100 is stuck, for example, in mud or wedged between rocks, the harness 102 grips the foot tighter as the force employed to pull up on the sandal 100 is increased. This design improves the probability that the sandal 100 will remain on the foot. Additionally, the sandal 100 exhibits a lightweight robust construction that is economical to produce.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A sandal comprising:

an elongated sole for supporting a foot, said sole having a toe end and a heel end;

a center toe strap anchored in said toe end, said center toe strap having a distal end fixedly connected to a front buckle;

a rear strap anchored in said heel end and having a first end and a second end extending above said sole, said first end and said second end respectively connected to an inside rear buckle and an outside rear buckle;

a self-adjusting harness comprised of a single strap anchored in said toe end, said single strap having an inside end and an outside end extending above said sole, said inside end being circuited through said front buckle and said inside rear buckle and said outside end being circuited through said front buckle and said outside rear buckle, said inside end and said outside end being engaged to form a closure over an instep of said foot; and an independent adjustable heel strap attached to said outside rear buckle and said inside rear buckle, wherein movements of said foot result in continuous adjustments in the tension of said single strap for regulating and equalizing the tension in said harness.

2. The sandal of claim 1 wherein said sole includes an insole layer.

3. The sandal of claim 1 wherein said sole includes an outsole layer.

4. The sandal of claim 1 wherein said sole includes a midsole layer.

5. The sandal of claim 1 wherein said center toe strap is bonded between an insole layer and an outsole layer of said sole.

6. The sandal of claim 4 wherein said midsole layer further includes a plurality of channels for bonding said center toe strap, said rear strap and said single strap of said harness between said insole layer and said outsole layer.

7. The sandal of claim 1 wherein said sole is shaped in the form of a human foot.

8. The sandal of claim 1 wherein each of said buckles includes a plurality of slots for enabling the attachment of said center toe strap and said first end and said second end of said rear strap.

9. The sandal of claim 1 wherein each of said buckles is comprised of plastic.

10. The sandal of claim 1 wherein said inside end and said outside end of said single strap of said harness are engaged with hook and loop fasteners to form said closure over the instep of said foot.

11. The sandal of claim 1 wherein said independent adjustable heel strap forms a closure about a heel of said foot with hook and loop fasteners.

12. The sandal of claim 1 wherein said center toe strap retains said front buckle in a stationary position to enable said harness to self-adjust.

13. A sandal comprising:

a sole for supporting a foot;

a center toe strap anchored in a toe end of said sole and having a distal end fixedly connected to a front buckle;

a rear strap anchored in a heel end of said sole and having a first end and a second end respectively connected to an inside rear buckle and an outside rear buckle;

a self-adjusting harness comprised of a single strap anchored in said toe end and having an inside end and an outside end, said inside end being circuited through said front buckle and said inside rear buckle and said outside end being circuited through said front buckle and said outside rear buckle, said inside end and said outside end being engaged to form a closure over an instep of said foot; and an independent adjustable heel strap attached to said outside rear buckle, wherein movements of said foot result in continuous adjustments in the tension of said single strap for regulating and equalizing the tension in said harness.

* * * * *